United States Patent [19]

Niklès et al.

[11] Patent Number: 4,903,253

[45] Date of Patent: Feb. 20, 1990

[54] MEANS FOR ATTACHING A BAND TO A WATCH CASE

[75] Inventors: François Niklès, Cressier; Gaston Gagnebin; Marco Bettelini, both of Bienne, all of Switzerland

[73] Assignee: ETA SA Fabriques d'Ebauches, Granges, Switzerland

[21] Appl. No.: 306,219

[22] Filed: Feb. 3, 1989

Related U.S. Application Data

[63] Continuation of Ser. No. 100,858, Sep. 25, 1987, abandoned.

[30] Foreign Application Priority Data

Oct. 22, 1986 [CH] Switzerland ..... 04200/86

[51] Int. Cl.[4] ..... G04B 37/00; A44C 5/14

[52] U.S. Cl. ..... 368/282; 224/167

[58] Field of Search ..... 368/281, 282; 224/169–180

[56] References Cited

U.S. PATENT DOCUMENTS

| | | | |
|---|---|---|---|
| 2,225,474 | 12/1940 | Guild | 224/4 |
| 3,469,391 | 9/1969 | Thevenaz | 368/282 |
| 4,034,552 | 7/1977 | Davidson | 368/282 |
| 4,167,850 | 9/1979 | Schneider | 368/282 |
| 4,194,355 | 3/1980 | Nishida | 368/282 |
| 4,417,821 | 11/1983 | Herchenbach | 368/281 |
| 4,506,992 | 3/1985 | Bonnet | 368/282 |

FOREIGN PATENT DOCUMENTS

| | | | |
|---|---|---|---|
| 935435 | 6/1948 | France . | |
| 2133940 | 2/1972 | France . | |
| 57-86776 | 5/1982 | Japan | 368/282 |
| 61-93974 | 5/1987 | Japan | 368/282 |
| 318509 | 2/1957 | Switzerland . | |
| 347490 | 8/1960 | Switzerland . | |
| 645498 | 10/1984 | Switzerland | 368/282 |

*Primary Examiner*—Vit W. Miska

*Attorney, Agent, or Firm*—Griffin, Branigan & Butler

[57] ABSTRACT

A watch case comprises a frame (5), a crystal (6) that may be welded or glued to the frame, and a base (13) that is fastened removably to the frame. The underside of the frame contains an undercut (16) that is covered by the base and that is shaped like the band end (2) which is inserted therein. The base includes at least one projection (17) shaped so as to pass through a matching opening (18) provided in the end of the band.

18 Claims, 3 Drawing Sheets

MEANS FOR ATTACHING A BAND TO A WATCH CASE

This is a continuation of application Ser. No. 100,858, filed Sept. 25, 1987, now abandoned.

BACKGROUND OF THE DISCLOSURE

The present invention relates to a watch case-band comprising a crystal, a frame designed to house a movement equipped with hands, and a base fastened removably to the frame, with the bottom edge of the frame having two diametrically opposed undercuts that each accommodate one end of the band, the shape of the undercut being essentially the same as the shape of the band inserted therein, and the base being shaped to cover the undercuts when the case is closed.

A watch case of the type described above is disclosed in U.S. Pat. No. CH-A-355 095. The patent describes a frame in which two undercuts or recesses have been fashioned. Within each of the undercuts is inserted a band end that flares into a dovetail shape and is held within the undercut by virtue of the fact that the flared end has the same shape as the undercut. The band is held in place axially when the base of the case is applied to the underside of the frame. This arrangement shares with the present invention the advantage of concealing the entire system for attaching the band to the case, thus creating the illusion that the band is of a piece with, and not separate from, the However, the abovementioned patent has several drawbacks. The first is that it requires special flared band ends. The flared portion may either be integral with, or connected to, the rest of the band, but either way it prevents the use of standard band ends with continuous or straight edges such as are found presently on the market. The second drawback is that it requires complicated recesses to be machined into the frame, which may be very difficult to accomplish if the frame is made of substances such as ceramics that are not easily susceptible to machining. A third drawback is that the attachment will not withstand the high tensile stresses that may be exerted on the band, since in such cases the band, which is typically made of leather or plastic, may become deformed and be pulled out of its housing.

In one particular arrangement, an attempt was made to retain the band by means of pins integral with a molded watch crystal and a ring screwed onto the base of the frame. This construction, described in document JP-U-1 149 226, has the disadvantage of being fragile, since the plastic pins break easily. It is also complicated, simply due to the presence of the ring.

Other objects of the invention and its mode of operation and construction will become apparent upon consideration of the following description and the accompanying drawing wherein embodiments are illustrated solely by way of example.

SUMMARY OF THE INVENTION

An object of the present invention is to provide an improvement in watch case-bands of the type having a crystal, a frame for housing a movement having hands, and a base removably fastened to the frame with the bottom edge of the frame having two diametrically opposed undercuts each accommodating one end of a band, the shape of the undercut being essentially the same as the shape of the band inserted therein and the case being shaped to cover the undercuts when the case is closed, the improvement comprising at least one projection formed integral with the base and extending into each undercut and passing through a matching opening in the band end so as to fasten the end to the watch case when the base is applied to the underside of the frame. The projection may be integrally formed with the base or it may be a pin driven into the base. The top and bottom of the undercut may lie in parallel planes which are perpendicular to the axis of the hands or which are at an angle other than 90° relative to the axis of the hands.

DESCRIPTION OF PREFERRED EMBODIMENTS

Figure 1:
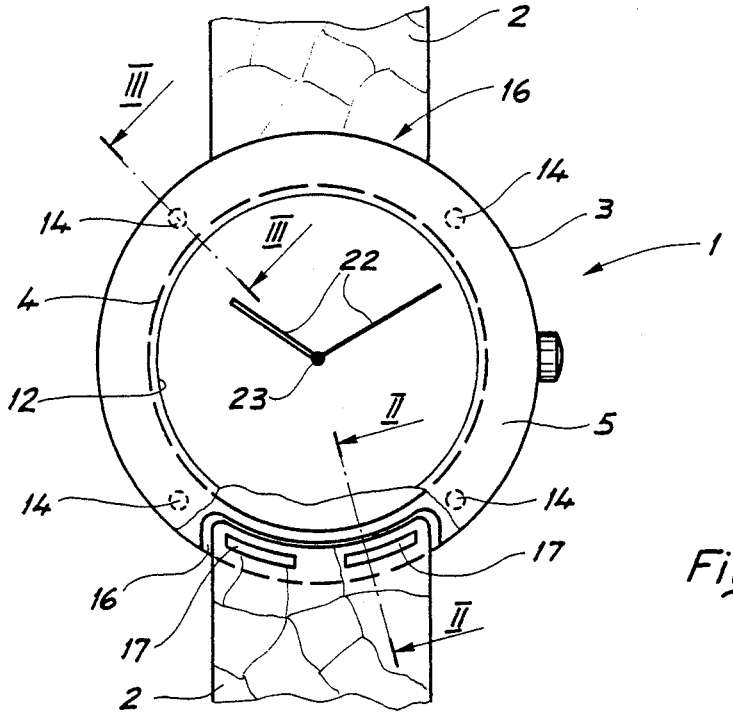
FIG. 1 is a top view, partially cut away, of one embodiment of the watch case of the invention.
Figure 4:
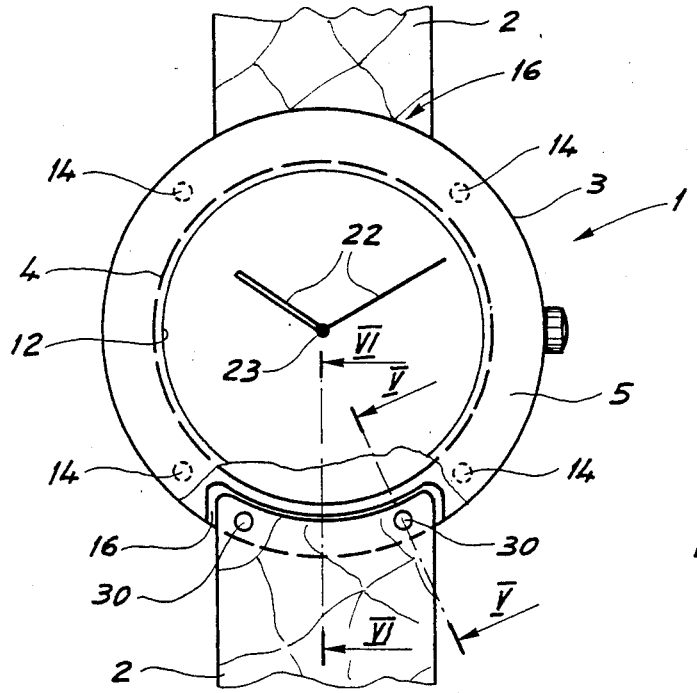
FIG. 4 is a top view, partially cut away, of a second embodiment of the watch case of the invention.

FIG. 1 is a top view of a first embodiment of the watch case of the invention. The case is identified generally as 1, and the band ends as 2. A side 3 defines the outer circumference of periphery 5 and circle 4 the inner circumference of frame 5. As illustrated in FIGS. 1 and 4, side 3 forms a continuous outside surface or outer periphery of frame 5 so that the frame has no projections extending outwardly of the outer periphery in the plane of the frame. The watchface in FIG. 1 is partially cut away at 6:00 o'clock in order to show how band 2 is fastened to case 1.

Figure 2:
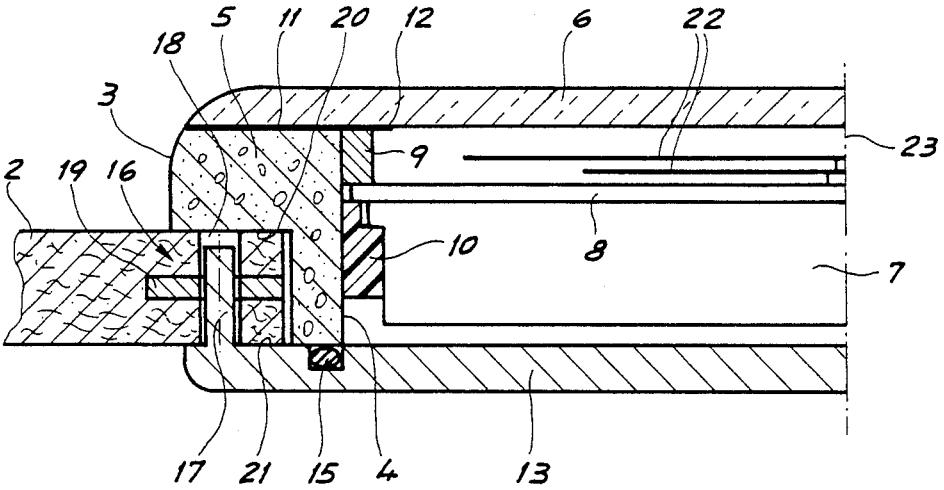
FIG. 2 is a cross-section along line II-II of FIG. 1.
Figure 3:
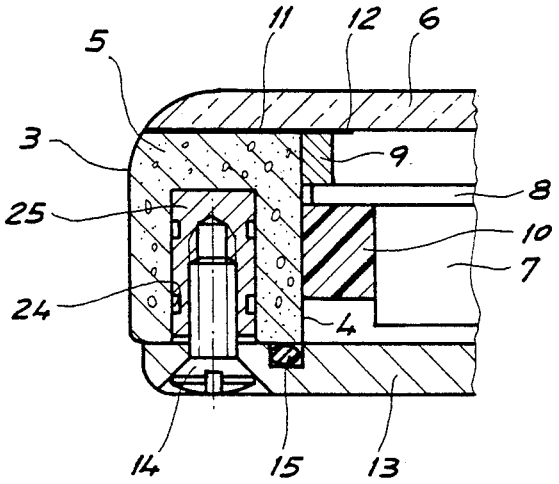
FIG. 3 is a cross-section along line III-III of FIG. 1.

FIG. 2, which is a cross-section along line II-II of FIG. 1, reveals frame 5, which is shaped like a ring delimited by circles 3 and 4. Frame 5 is covered with a glued or welded crystal 6. The interior of frame 5 serves to house a movement 7 and the watchface 8, which are held in place by a spacer 9 and a ring 10. Movement 7 has hands 22 that turn about an axis 23. In order to conceal frame 5 and spacer 9, crystal 6 is plated with metal plating 11 having an inner edge 12. A base 13 is removably fastened to frame 5 by means of screws 14 as shown in FIG. 3. A gasket 15 serves to seal the watch. FIGS. 1 and 2 also show that the underside of frame 5 contains two diametrically opposed undercuts that each accommodate one end 2 of the band. The shape of undercuts 16 is essentially the same as the shape of the band ends 2 that are inserted therein. When base 13 is applied to frame 5, undercuts 16 are covered, so that band end 2 is contained between the base and the frame.

In accordance with the invention, at least one projection 17 is formed integral with base 13. The projection extends into undercut 16 and passes through a matching opening 18 provided in the band end 2 in such a way that the end is fastened to the case when the cover is applied to the underside of the frame.

In a variant of this general embodiment, FIGS. 1 and 2 show base 13 as having two projections 17, each protruding integrally from the base. The base, with its projections or protrusions, is produced by turning and milling. To reinforce the points of attachment of band end 2 to case 1 a grommet 19, which may be made of metal, may be built into the band end. This variant, in which the protrusions are shaped like segments of a crown, allows for maximum reduction of the overall thickness of the watch and is therefore particularly suitable for a ladies watch. Of course, in this embodiment, the openings 18 in the band end will also be shaped like segments of a crown.

FIG. 2 also shows that one surface 20 of undercut 16, extending opposite that part 21 of the base 13 that covers said undercut, combines with said part 21 to form two planes between which band end 2 is sandwiched, said planes being perpendicular to the axis 3 of the hands 22, thereby causing band end 2 to emerge from the case in a plane that is perpendicular to the axis. This arrangement is to be used for small-diameter watches, particularly ladies watches, of which the diameter is on the order of at most 22 mm.

FIG. 3 is a cross-section along line III—III of FIG. 1 and shows the manner in which base 13 is fastened to frame 5 by means of screws 14. FIG. 1 shows that four attachment points are provided. Frame 5 contains holes 24 into which plugs 25 are driven. The plug is then drilled and tapped, using as a reference interior bore 4 of frame 5. This technique is designed for use in cases where the frame is made of a hard material such as a ceramic. The plugs would not be needed if the frame were made of steel or a precious metal.

FIG. 4 is a top view of a second embodiment of the watch case of the invention. This second embodiment is distinguished from the first only by its attachment system, and by the fact that the band ends are angled with respect to the axis of the hands of the watch. Therefore, details of construction that are identical to those set forth with reference to FIGS. 1, 2, and 3 will not be repeated, and the same reference numerals are used to identify identical parts.

Figure 6:
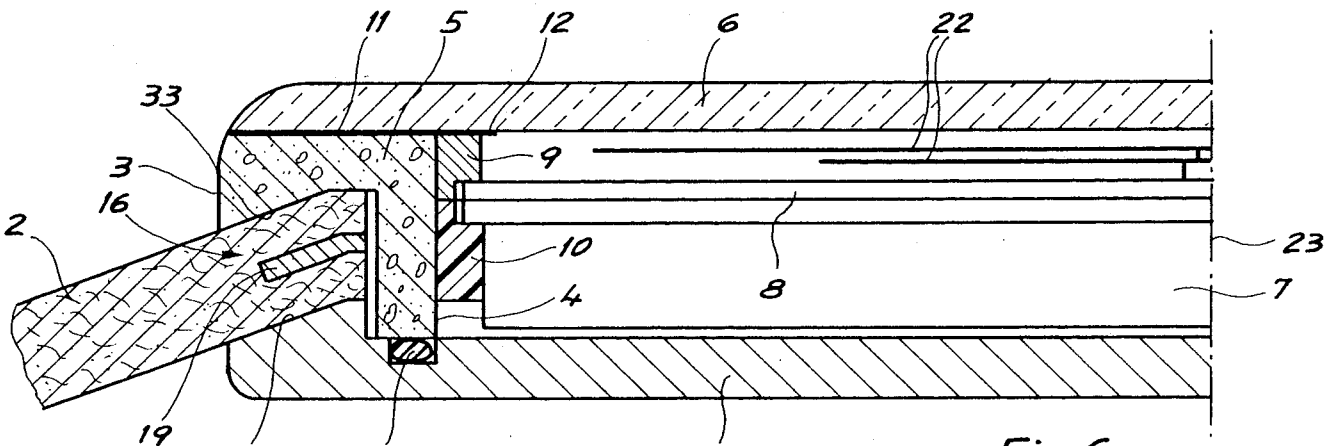
FIG. 6 is a cross-section along line VI-VI of FIG. 4.
Figure 5:
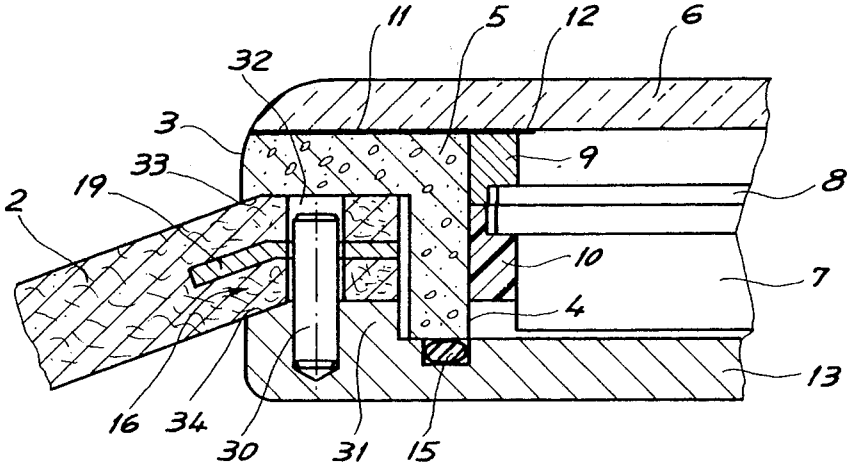
FIG. 5 is a cross-section along line V-V of FIG. 4.

FIGS. 5 and 6, which are cross sections along lines V—V and VI—VI, respectively, of FIG. 4, show that the underside of frame 5 has two diametrically opposed undercuts 16 that each accommodate a band end 2. The base 13 supports two projections 30 for each undercut 16, with the projections taking the shape of straight pins driven into the base. In order that the pin will be well anchored within the base, the base widens or is made thicker in the region 31 where the base covers undercut 16. Pins 30 extend into undercut 16 and pass through a corresponding opening 32 fashioned in band end 2. In this embodiment, openings 32 are simple circular holes drilled into the band end, the diameter of the openings being adjusted to the diameter of pins 30. As in the preceding embodiment, the band end may be reinforced with a grommet 19. FIGS. 5 and 6 also show that one surface 33 of undercut 16, extending opposite that part 34 of base 13 that covers the undercut, combines with part 34 to form two planes, between which the band end 2 is sandwiched, with the planes being inclined with respect to the axis 23 of watch hands 22, at least near the periphery of case 1, thereby causing the band end 2 to emerge from the case in a plane that is inclined with respect to the axis 23.

The use of pins to fasten the band, and the arrangement by which the band ends emerge from the case at an angle, are designed especially for use with large-diameter watches, e.g., 40 mm. In such cases, greater thickness is available for use, which makes it possible to reinforce the base at the points where the pins 30 are inserted, and to use a fastening system that is simpler than the one using crown segments as in the previous embodiment. Similarly, the angling of the band ends is justified in view of the large diameter of the case. This arrangement enables the band to follow the shape of the wrist from the very point at which it emerges from the watch case. If one wishes to reinforce the band end at the attachment points, it is possible, as in the preceding embodiment to use a reinforcing grommet 19, which would also be angled, as shown in FIGS. 5 and 6.

The two embodiments described above are particularly appropriate if the frame 5 is made of a very hard substance such as a ceramic or metal carbide. In the case of ceramics, undercuts 12 can be formed directly by sintering, without requiring any subsequent operations. Only the surfaces that will receive crystal 6 and movement 7 need be machined. It is obvious that the frame might be made of another substance such as stainless steel or a precious metal such as gold.

It will also be noted that in the construction disclosed, all of the tensile stress is borne by projections that are parts of the base of the watch case. The frame is free of any stress. This is advantageous in cases where the frame is made of a ceramic material, which may crack or even break if subjected to certain mechanical stress.

While preferred embodiments of the invention have been described in specific detail, it will be understood that various modifications and substitutions may be made in the described embodiments without departing from the spirit and scope of the invention as defined by the appended claims.

The embodiments of the invention in which an exclusive property or privilege are claimed are defined as follows.

We claim:

1. A watch case comprising a crystal (6), a single piece watch frame (5) having an inner periphery surrounding and laterally confining a watch movement (7) equipped with hands (22), said frame having an outer periphery spaced from and extending parallel to said inner periphery and defined by a side (3) having no projections extending outwardly of said outer periphery in the plane of said frame and a base (13) fastened removably to the frame, with the bottom edge of said frame having two diametrically opposed undercuts (16) extending from said outer periphery toward said inner periphery by a distance less than the space between said inner and outer peripheries and shaped to accommodate one end (2) of a band, the shape of each said undercut being essentially the same as the shape of the band inserted therein, and said base being shaped to cover said undercuts when the case is closed, said watch case further comprising:

at least one projection (17, 30) integral with the base and extending into each undercut and passing through a matching opening (18, 32) fashioned in the band end so as to fasten said end to the watch case when the base is applied to the underside of the frame.

2. The improvement as claimed in claim 1 wherein said base has two projections per undercut and each band end has two corresponding openings.

3. The improvement as claimed in claim 2 wherein each projection is a straight pin (30) driven into the base.

4. The improvement as claimed in claim 2 wherein each projection comprises a protrusion (17) forming one piece with the base.

5. The improvement as claimed in claim 1 wherein the projection (17) takes the shape of a segment of a crown.

6. The improvement as claimed in claim 1 wherein each band end is reinforced with a grommet (19) at the point of attachment to the case.

7. The improvement as claimed in claim 1 wherein the frame (5) is a ceramic ring.

8. The improvement as claimed in claim 1 wherein the frame (5) is a ring made of a precious metal.

9. The improvement as claimed in claim 1 wherein one surface (20) of the undercut (16) extending opposite that part (21) of the base (13) that serves to cover said undercut combines with said part (21) to form two plane surfaces between which the band end is sandwiched, with said plane so as to cause said end to emerge from the case in a plane perpendicular to said axis.

10. The improvement as claimed in claim 1 wherein one surface (33) of the undercut (16) extending opposite that part (34) of the base (13) that serves to cover said undercut combines with said part (34) to form two plane surfaces between which the band end is sandwiched, with said plane surfaces being angled with respect to the axis (23) of the hands (22), at least in the area near the periphery of the case, so as to cause said end to emerge from the case in a plane that is inclined with respect to said axis.

11. A watch case of the type comprising a crystal, a watch frame for housing a movement equipped with hands, a base fastened to said frame; and a band, the improvement wherein:

said frame comprises a continuous closed body for surrounding said movement, said frame having an inside surface defining a region in which said movement is located, a top side, a bottom side, and a continuous outside surface defining a frame periphery having no projections extending outwardly in the plane of said frame, said inside and outside surfaces being parallel and spaced apart;

said crystal being attached to said top side of said frame;

said base being removably fastened to said bottom side of said frame and said base being substantially flat where it contacts said frame;

said band having first and second flat ends each having a hole therein;

said frame being undercut at two diametrically opposed locations so as to form, with said base, two recesses, each defined by parallel flat surfaces of said frame and said base, extending inwardly from said outside surface toward said inside surface by a distance less than the space between said inside and outside surfaces for accommodating respective ends of said band;

at least two projections extending from said base, each said projection extending into one of said recesses and one of said holes whereby the ends of said band are secured to said watch case when said base is fastened to said frame.

12. The improvement as claimed in claim 11 wherein said frame has a smooth continuous circular outside surface.

13. The improvement as claimed in claim 12 wherein said crystal entirely covers said top surface of said frame.

14. The improvement as claimed in claim 11 wherein the depth of said recesses is substantially the same as the thicknesses of the ends of said bands.

15. A watch case comprising a crystal, a watch frame having an inner periphery surrounding and laterally confining a watch movement equipped with hands, said frame having an outer periphery spaced from and extending parallel to said inner periphery, and a base removably fastened to the frame, said frame having a bottom edge with two diametrically opposed undercuts extending from said outer periphery toward said inner periphery by a distance less than the distance between said inner and outer peripheries and each shaped to accommodate one end of a band, the shape of each undercut being essentially the same as the shape of a band inserted therein, and said base being shaped to cover said undercuts when the case is closed, said watch further including at least one projection integral with the base and extending into each undercut and passing through a matching opening fashioned in the band end so as to fasten said end to the watch case when the base is applied to the underside of the frame.

16. A watch case as claimed in claim 15 wherein said watch frame is a single piece watch frame.

17. A watch case as claimed in claim 15 wherein said frame consists of a single ceramic ring.

18. A watch case as claimed in claim 15 wherein said frame consists of a single piece in the shape of a ring.

* * * * *